US006745698B2

(12) United States Patent
Beal

(10) Patent No.: US 6,745,698 B2
(45) Date of Patent: Jun. 8, 2004

(54) PROJECTILE JACKET HAVING FRANGIBLE CLOSED END

(75) Inventor: Harold F. Beal, Rockford, TN (US)

(73) Assignee: Doris Nebel Beal Inter Vivos Patent Trust, Pawleys Island, SC (US)

( * ) Notice: Subject to any disclaimer, the term of this patent is extended or adjusted under 35 U.S.C. 154(b) by 0 days.

(21) Appl. No.: 10/075,334

(22) Filed: Feb. 14, 2002

(65) Prior Publication Data

US 2003/0150349 A1 Aug. 14, 2003

(51) Int. Cl.[7] ..... F42B 12/34

(52) U.S. Cl. ..... 102/506; 102/507; 102/516; 102/517; 102/529

(58) Field of Search ..... 102/493, 501, 102/502, 506–510, 513, 514–519, 520–523, 398, 529

(56) References Cited

U.S. PATENT DOCUMENTS 2,007,026 A * 7/1935 Robertson ..... 102/493
2,183,502 A * 12/1939 Lefere ..... 86/56
2,382,152 A * 8/1945 Jakobsson ..... 102/523
3,170,405 A * 2/1965 Jungermann et al. ..... 102/529
3,528,662 A * 9/1970 Merchant et al. ..... 102/529
3,865,038 A * 2/1975 Barr ..... 102/502
4,774,745 A * 10/1988 Carter ..... 86/56
5,035,183 A * 7/1991 Luxton ..... 102/502
5,789,698 A * 8/1998 Beal ..... 102/516

* cited by examiner

*Primary Examiner*—Harold J. Tudor
(74) *Attorney, Agent, or Firm*—Pitts & Brittian, PC

(57) ABSTRACT

A frangible projectile for gun ammunition wherein the projectile includes a core formed from one or more metal powders which are pressed into a self-supporting compact and incorporated into a metal jacket. The metal jacket is initially cup-shaped (generally cylindrical in overall geometry) with an open end and a closed end. In accordance with one embodiment of the present invention the closed end of the jacket becomes the trailing end of the projectile. In another embodiment, the closed end of the jacket becomes the leading end of the projectile. In either embodiment, that surface of the closed end of the jacket which faces inwardly of the volume of the jacket is indented and stressed over substantially its entire area in accordance with a pattern which enhances the frangibility of this closed end of the projectile when the projectile strikes a target. In either embodiment, upon the projectile of the present invention striking a relatively hard target, the initially closed end of the jacket, which now has been indented and stressed, disintegrates into minute particulates, each of which loses its momentum rapidly such that these particulates fall harmless away from the target.

11 Claims, 4 Drawing Sheets

PROJECTILE JACKET HAVING FRANGIBLE CLOSED END

FIELD OF INVENTION

This invention relates to gun ammunition projectiles and particularly to frangible projectiles and more particularly to frangible projectiles for use in pistol or rifle ammunition.

BACKGROUND OF INVENTION

In the art there exists a major concern relating to the danger associated with ricocheting projectiles fired from guns, especially from pistols and rifles of 50 caliber or smaller calibers. Major litigation has arisen seeking monetary recovery from law enforcement officers and/or governmental agencies as compensation from injury to a bystander or other innocent person struck by a ricocheting projectile or portion of a projectile. Also importantly, ricocheting projectiles are a very present danger to fellow law enforcement officers when gunfire erupts within a closed area, such as border patrol officers inspecting the holds of ships for contraband, etc. Further, training of law enforcement officers commonly includes participating in exercises which include entry into a "alive fire house". These exercises involve rapid entry by a number of officers into a "live fire house" training building and live firing of weapons at designated targets within the building. The presence of several officers within the enclosure, each of which may be firing their weapon, generates a real danger of injury of an officer by reason of their being struck by a ricocheting portion or all of a projectile.

Projectiles of the prior art have almost exclusively included a lead core, either with or without an outer covering of the core. In either event, lead has been recognized as an environmental pollutant and is now either banned or being considered for banning, in most projectiles. Moreover, lead projectile tend to ricochet from many surfaces which have a hardness on the order of a hardwood.

To solve both the environmental concerns and the ricochet tendency of lead projectiles, there have been developed projectiles formed from a combination of materials which are collectively frangible when the projectile strikes a target. In those instances where these newer projectiles include a core which is housed within a metal, usually copper, jacket, the frangibility of the jacket is of concern. This is particularly true when the projectile strikes a surface having a hardness on the order of mild steel or harder. Under these latter conditions, fragments of the jacket may ricochet off the hard target and become independent small projectiles which can be injurious to an unintended target, such as a bystander or even the shooter. Depending upon various factors such as distance, outerwear protection, size of fragment, etc., such fragments can be lethal.

SUMMARY OF INVENTION

The present invention comprises a frangible projectile for gun ammunition wherein the projectile includes a core formed from one or more metal powders which are pressed into a self-supporting compact and incorporated into a metal jacket. The metal jacket is initially cup-shaped (generally cylindrical in overall geometry) with an open end and a closed end. In accordance with one embodiment of the present invention the closed end of the jacket becomes the trailing end of the projectile. In another embodiment, the closed end of the jacket becomes the leading end of the projectile. In either embodiment, that surface of the closed end of the jacket which faces inwardly of the volume of the jacket is indented and stressed over substantially its entire area in accordance with a pattern which enhances the frangibility of this closed end of the projectile when the projectile strikes a target. In either embodiment, upon the projectile of the present invention striking a relatively hard target, the initially closed end of the jacket, which now has been indented and stressed, disintegrates into minute particulates, each of which loses its momentum rapidly such that these particulates fall harmless away from the target.

DETAILED DESCRIPTION OF THE INVENTION

Figure 1:
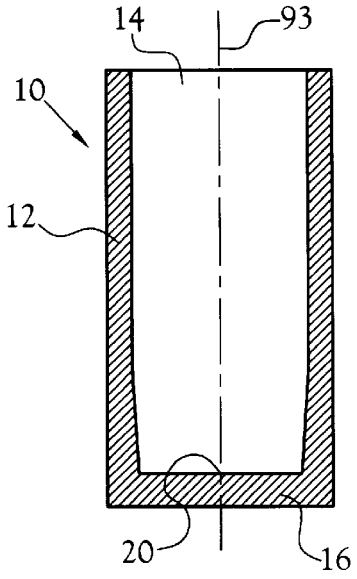
FIG. 1 is a side view, in section, of a metal jacket suitable for use in a projectile of the present invention.

FIG. 1 depicts a typical cup-shaped jacket 10 as employed in the manufacture of a projectile for gun ammunition. The depicted jacket is chosen to illustrate the present invention when manufacturing a projectile for a .223 caliber rifle and the dimensions referenced herein as directed to this jacket. It is to be recognized that other caliber projectiles, for either pistols or rifles of 50 caliber or smaller, may be manufactured employing the present invention and will exhibit the novel features referenced herein. The depicted jacket is thin-walled 12, e.g., having a wall thickness of about 0.013", is open at one end 14 and is closed at its opposite end 16 to define an interior surface 20. In most instances, due to its mode of manufacture, the wall thickness of the jacket adjacent its closed end increases by a few thousandths of an inch. The closed end or base of the jacket is commonly about 0.030" thick.

The present inventor has found that when a jacket of the prior art is employed in the manufacture of a projectile which is otherwise frangible to the extent that the projectile disintegrates into very small particulates when the projectile is fired from a pistol or rifle into a relatively hard target, the closed end of the prior art jacket fails to disintegrate into particulates of harmless size. Rather, the closed end of the jacket either remains intact or disintegrates only into fragments of a size which can ricochet from the target and retain sufficient energy to cause injury, or even be lethal, to bystanders or to cause damage to property.

Figure 2:
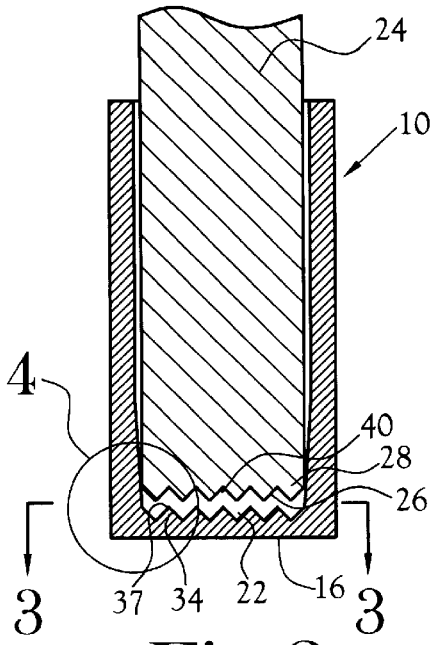
FIG. 2 is a side view of the jacket depicted in FIG. 1 and depicting a punch suitable for indenting the closed end of the jacket.

Referring initially to FIGS. 1 and 2, in accordance with one embodiment of the present invention, the interiorly-facing surface 20 of the closed end 16 of a metal, commonly copper metal, jacket 10 is indented to define a pattern of indentations 22, as by means of a punch 24 having a pattern of projections 26 projecting from the distal face 40 of the distal end 28 of the punch.

Figure 3:
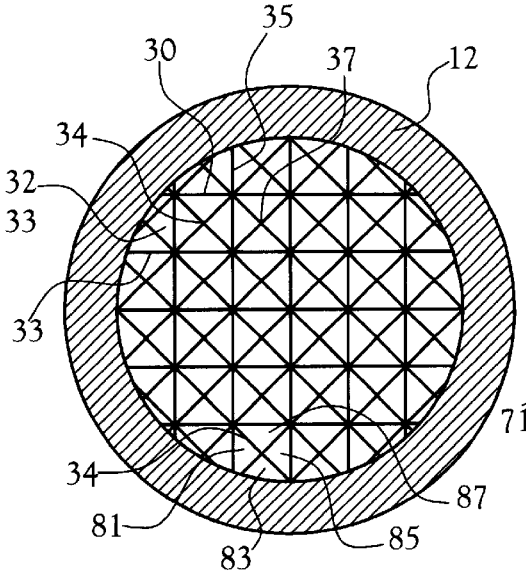
FIG. 3 is an enlarged representation of one embodiment of a suitable pattern of indentations imparted to the inner surface of the closed end of the jacket depicted in FIGS. 1 and 2 and taken generally along the line 3—3 of FIG. 2.
Figure 4:
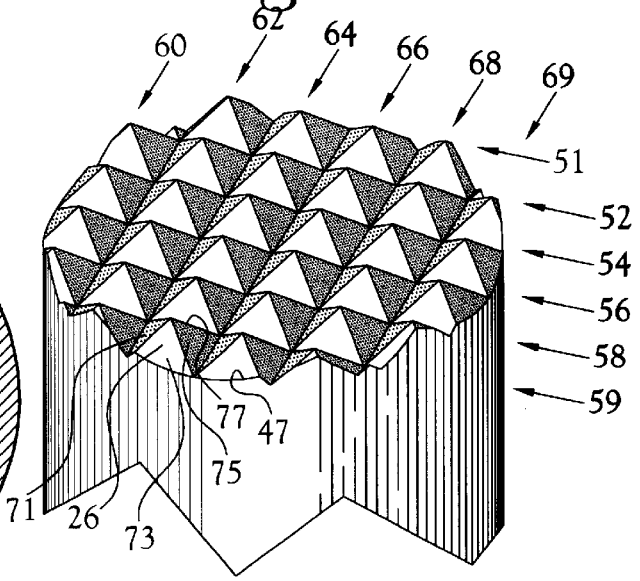
FIG. 4 is an enlarged schematic representation of the digital end of a punch and depicting the geometry of one embodiment of projections suitable for developing the indentation pattern depicted in FIG. 3.

FIG. 3 is an enlarged view of one embodiment of an indented pattern formed in the interior surface of the closed end 16 of a jacket 10. The pattern of indentations depicted in FIGS. 3 and 4 comprises a square pattern of vertical rows 30 and horizontal rows 32 of pyramidal indentations 34 which project into the closed end of the jacket. The bases of the plurality of pyramidal indentations face inwardly of the interior volume of the jacket and are interconnected as by vertical and horizontal ribs 33 and 35, respectively, which intersect one another, preferably at right angles. In the depicted embodiment, there are six parallel rows of pyramidal indentations in each of the horizontal and vertical directions as viewed in FIG. 3. An enlarged schematic view of a portion of the indented interior surface 20 of the closed end 16 of the jacket 10 is depicted in FIG. 5 wherein it will be seen that the pattern of indentations comprises a plurality of side-by-side pyramidal indentations 34 whose respective apices 37 terminate within the closed end of the jacket.

Figure 5:
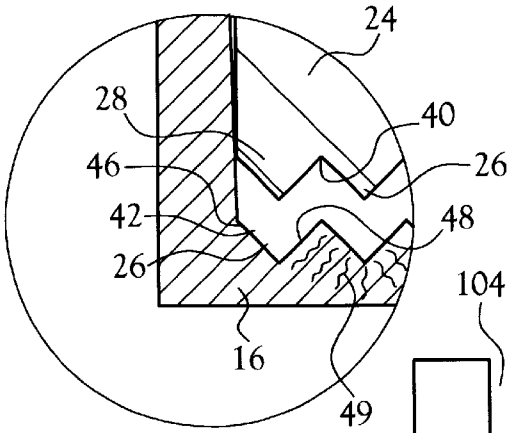
FIG. 5 is an enlarged view, in section, of a portion of the jacket and punch depicted in FIG. 2 and taken generally along the line 5—5 of FIG. 2.
Figure 9:
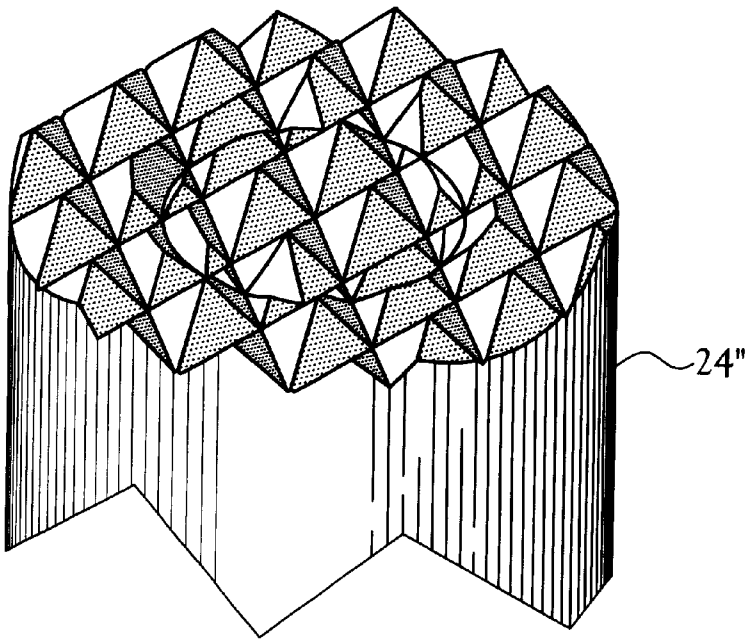
FIG. 9 is an enlarged representation of the distal end of a still further punch useful in indenting the interior surface of 10 the closed end of a jacket as depicted in FIG. 2.
Figure 8:
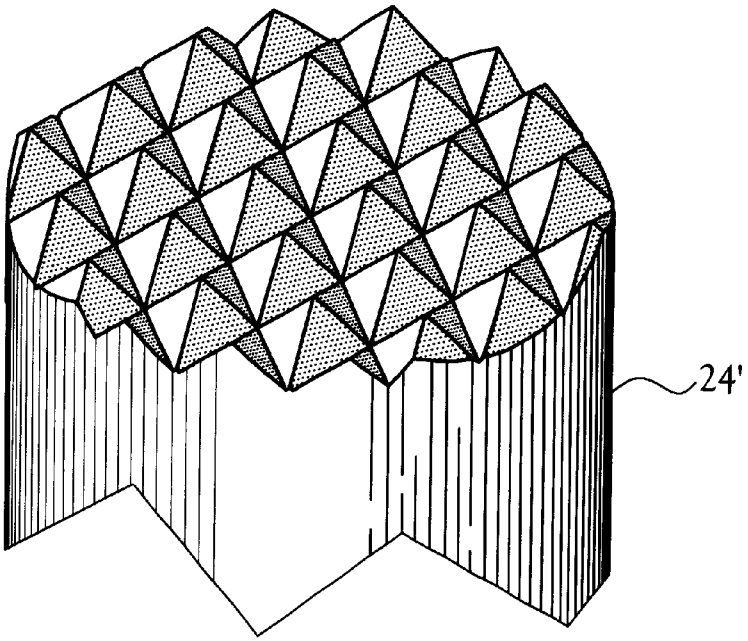
FIG. 8 is an enlarged representation of the distal end of a further embodiment of a punch useful in indenting the interior surface of the closed end of a jacket as depicted in FIG. 2.

Referring to FIG. 5, there is depicted an enlarged and sectioned portion of one corner of the jacket 10 and punch 24 depicted in FIG. 2 taken generally along the line 4—4 of FIG. 2. In this depicted embodiment, and referring also to FIG. 4,the pattern of projections 26 on the distal face of the depicted punch is defined by six elongated parallel rows of pyramidal projections 51,52,54,56 58 and 59 extending horizontally (as viewed in FIG. 4) fully across the face of the punch at equally spaced apart locations, and six elongated parallel rows of pyramidal projections 60,62,64,66, 68 and 69 extending vertically fully across the face 47 of the punch at equally spaced apart locations and extending fully across the face of the punch. The horizontal and vertical rows of projections intersect each other, preferably at right angles. In accordance with one aspect of the present invention, the pattern of projections on the face of the punch, including the angle of slope of the sides of each pyramidal projection and the height of each such projection, is chosen to develop a like sided and like spaced apart pyramidal indentations into the interior surface of the closed end of the jacket when the projections on the face of the punch are impressed into the interior surface of the closed end of the jacket. In the depicted embodiment, the punch bottoms out when the plane of its distal face 40 engages the plane of the original unindented interior surface of the closed end of the jacket, thereby forming equally spaced indentations each having a depth which is substantially equal to the height of a respective projection. In the depicted embodiment of FIGS. 3 and 4, the side 71, 73, 75, and 77 of a typical projection 26 on the face of the punch define the side faces 81, 83, 85, and 87 on a corresponding typical indentation 34. Thus, the surface 20 of the closed end of the jacket 10 comprises a plurality of intersecting rows of individual pyramidal indentations which extend into the closed end of the jacket and whose respective bottom side edges are essentially connected to the side edges of contiguous ones of their neighboring pyramidal projections. In a preferred embodiment, the individual indentations are each of like size and shape, thereby lending uniformity of distribution of the pyramidal indentations over substantially the entire interior surface of the closed end of the jacket. As depicted in FIGS. 8, and 9 the pattern of indentations into the interior surface may assume any of many geometrical configurations, including differently sized and/or shaped indentations in a given pattern, so long as the indentations are uniformly (in size and shape) distributed radially of the longitudinal center line 93 of the jacket.

In a preferred embodiment for a jacket for forming a .223 caliber projectile, the closed end 16 of the jacket 10 is of about 0.030" thickness. In this embodiment, the height of each of the projections 26 from the distal face 47 of the punch is about 0.015", thus defining a height of about 0.015" for each pyramid 34, and leaving about 0.015" of thickness of the closed end of the jacket intact. Preferably, in accordance with one aspect of the present invention, it is desired that the number of indentations be maximized, taking into consideration, among other things, the extent to which the indentations lessen the tensile strength of the closed end of the jacket, thereby maximizing the number of sites of fracture of the closed end of the jacket upon it striking a target. By way of example, between about 24 and 48 indentations have been found to provide the desired disintegration of the closed end of a .223 projectile jacket. Moreover, the total area of the interior surface of the closed end of the jacket which is covered by the total area of the indentations preferably is between about 80% and 100% of the total area of the interior surface of the closed end of the jacket, i.e., the indentations may be slightly separated from one another or they may have common outboard perimeters between adjacent indentations. On the other hand, preferably the depth of the indentations into the closed end of the jacket does not exceed between about 50% and about 75% of the thickness of the closed end of the jacket, thereby leaving sufficient thickness of the closed end as will withstand handling and firing of the projectile to a target without disintegration prior to striking a target.

Further referring to FIG. 5, there are depicted multiple stress lines 49 (typical), which develop within the closed end 16 of the jacket upon the projections of the punch 24 being forced into the closed end of the jacket to define the plurality of pyramidal indentations in the closed end. These stress lines represent avenues along which a fracture originating between or within adjacent ones of the pyramidal indentations may propagate into the intact unindented portion of the closed end of the jacket upon the projectile striking a relatively hard surface. These stress lines thus function to further enhance the disintegration of the closed end of the jacket into fragments which are sufficiently small as to possess insufficient energy as to present a danger to persons or property located near a target impacted by a projectile of the present invention.

Whereas pyramidal indentations into the interior surface of the closed end of the jacket are most suitable, other geometric configurations of the indentations are acceptable, for example, indentations having a cross-section of rhomboidal or diamond geometry or a mixture of geometric configurations as depicted in FIGS. 8 and 9. Likewise, the pattern of the indentations may vary quite widely. Preferably, the pattern of indentations provides for indentations over substantially the full area of the interior surface of the closed end of the jacket. In any event, it is desired that a maximum number of side-by-side indentations be provided, and that these indentations extend substantially fully over the area of the interiorly facing surface 20 of the jacket, thereby ensuring frangibility of all portions of the closed end of the jacket into harmless fragments, irrespective of whether the closed end of the jacket ultimately becomes the leading or trailing end of a projectile. Further, desirably the indentations are uniform in geometry and spacing radially from the longitudinal centerline 93 of the jacket over the overall interior surface of the closed end to avoid creating an imbalance of spin stability of the projectile about its longitudinal axis, when fired from a gun.

Figure 6C:
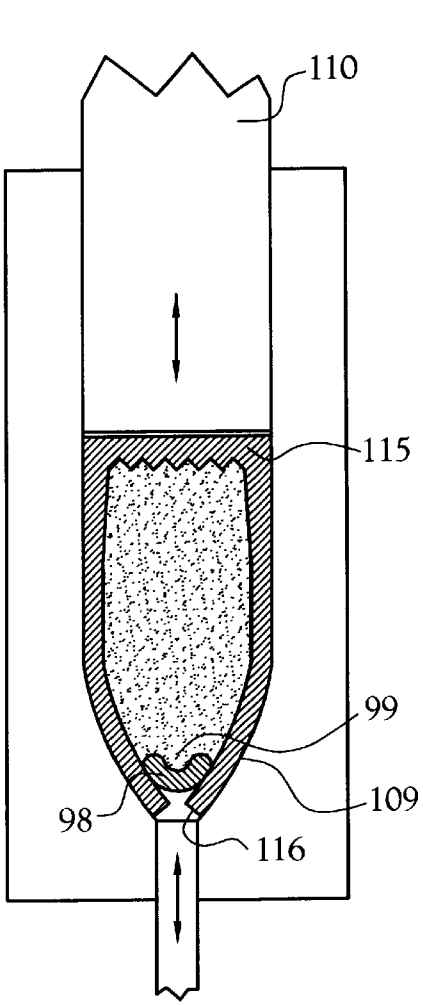
FIG. 6C is a representation of a still further step in the manufacture of the embodiment of the projectile depicted in FIG. 6A.
Figure 6B:
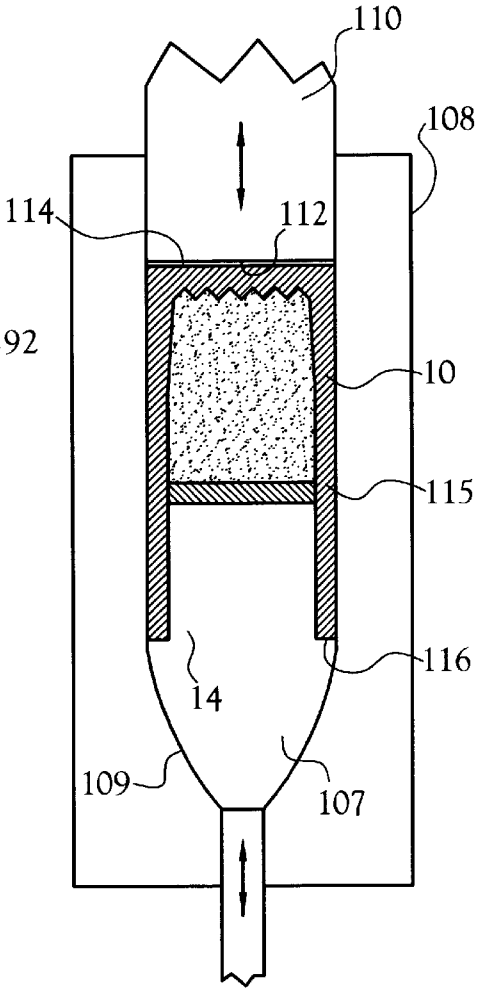
FIG. 6B is a representation of a further step in the manufacture of the embodiment of the projectile depicted in FIG. 6A.
Figure 6A:
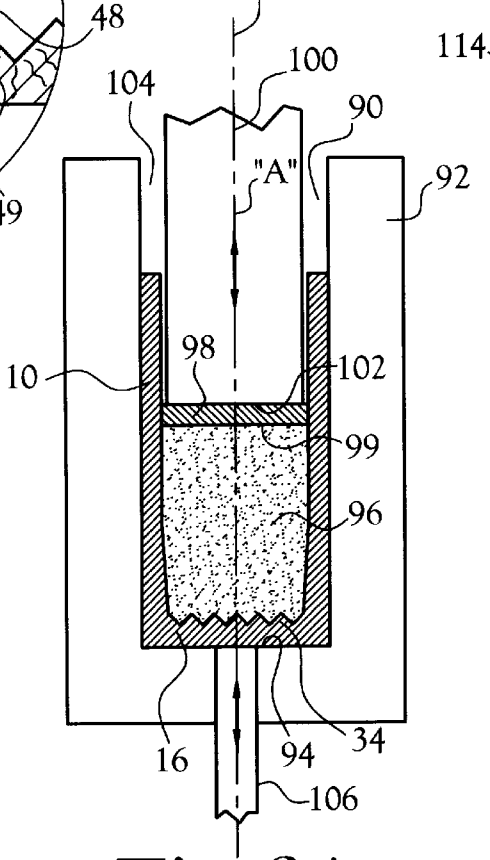
FIG. 6A is a representation of one step in the manufacture of a projectile embodying a jacket having an indented closed end and wherein the closed end of the jacket defines the trailing end of the projectile.

One embodiment of a method for the manufacture of a projectile of the present invention is depicted in FIGS. 6A–6C. In FIG. 6A, there is depicted a jacket 10, which has been provided with a plurality of indentations 34 in the manner depicted in FIG. 2, disposed within a cavity 90 of a die 92, with the closed end 16 of the jacket seated against the closed bottom end 94 of the die. A powder-based core 96 is disposed within the jacket adjacent the closed end of the jacket. A disc 98 of a material such as tin and having a diameter substantially equal to the internal diameter of the jacket at the location of the outboard end 99 of the core 96, is positioned within the jacket in overlying relationship to the outboard end of the core. A reciprocatory punch 100 having a flat planar end 102 is inserted within the open end 104 of the jacket and into engagement with the disc 98, hence with the core 96. Axial pressure is applied via the punch (see arrow "X") to seat the core fully within the jacket adjacent the closed end of the jacket. This action further serves to flatten the disc to the extent that it becomes wedged into a fixed position within the jacket to thereby maintain the core within the jacket during subsequent processing operations.

The jacket with the seated core and disc therein is ejected from the die 92 as by an ejector punch 106. Thereupon, as depicted in FIGS. 6B and 6C, the jacket/core/disc combination is inserted into the cavity 107 of a die 108 having an ogive portion 109, with the open end 14 of the jacket disposed adjacent the ogive portion of the cavity. Thereupon, a reciprocatory punch 110 having a flat planar end 112 is activated to apply axial pressure against the outer surface 114 of the closed end 16 of the jacket 10 to thereby urge the jacket/core/disc combination 115 into the ogive of the die. This action forces the outer perimeter 116 of the open end 14 of the jacket inwardly of the jacket toward its longitudinal centerline 118, partially crushes at least the outboard end 99 of the powder-base core causing the core to move into the ogive portion of the die and assume the desired ogive geometry for the projectile, and deforms the disc 98 into a generally hollow cup-shaped geometry which at least partially fills the now substantially closed, formerly open end, of the jacket. The thus-formed projectile is ejected from the die as by an ejector punch 120 and the completed projectile is recovered for use in a round of gun ammunition. Notably, in this embodiment of the method of the present invention, the closed end of the jacket defines the trailing end of the projectile during its flight to a target.

Figures 7A, 7B, 7C, 7D:
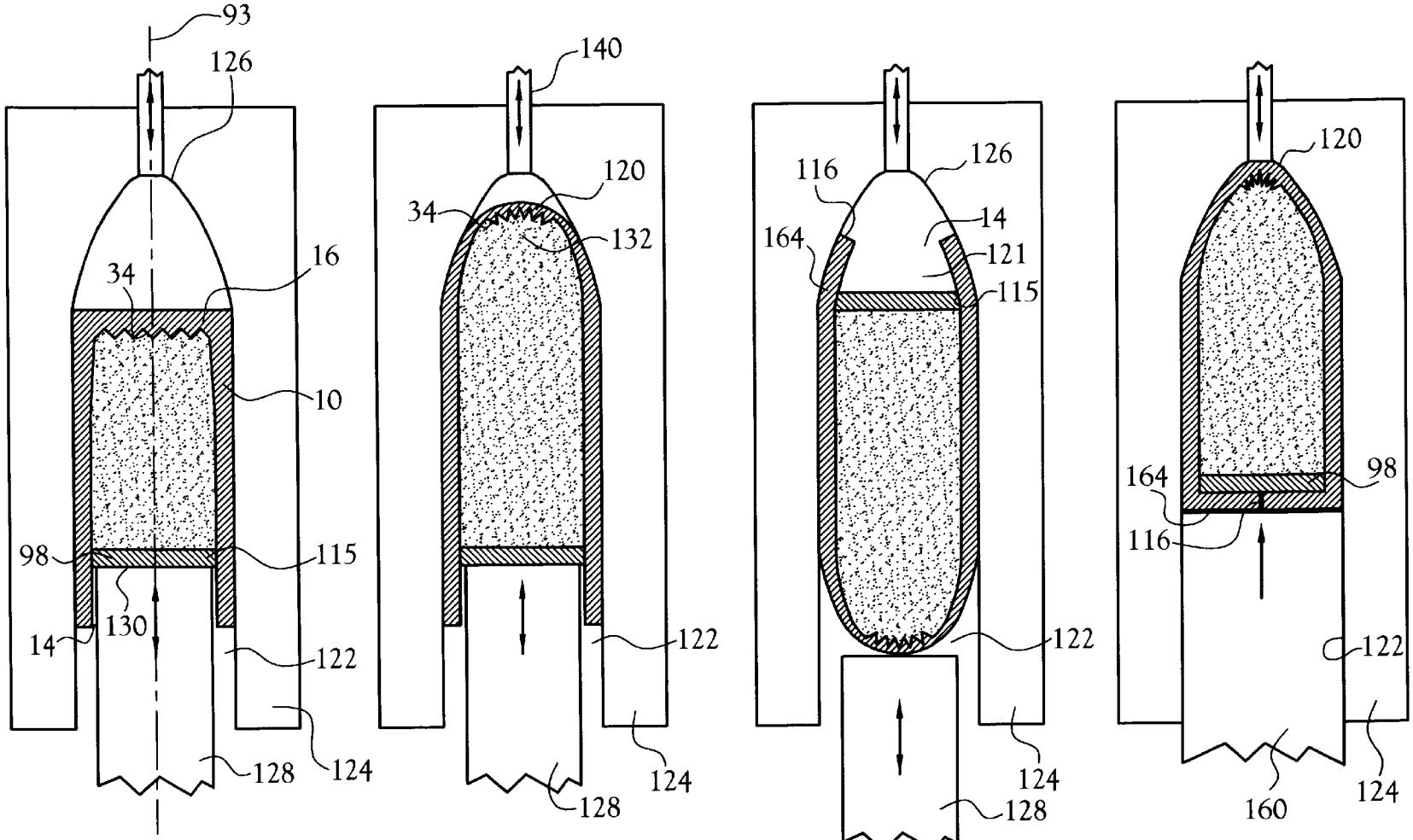
FIG. 7A is a representation of one step in the manufacture of a further embodiment of a projectile wherein the indented closed end defines the leading end of the projectile.
FIG. 7B is a representation of a further step in the manufacture of the further embodiment of a projectile.
FIG. 7C is a representation of a still further step in the manufacture of the further embodiment of a projectile; and, FIG. 7D is a representation of an even further step in the manufacture of the further embodiment of a projectile.

Referring to FIGS. 7A–7D, in accordance with one embodiment of the present invention, the closed end 16 of the jacket 10 may define the leading end 120 (FIGS. 7B and 7D) of the projectile when it is fired toward a target. In this embodiment, as seen in FIG. 7A, a jacket/core/disc combination 115 as depicted in FIG. 5B, is inserted into the cavity 122 of a die 124 having a rounded closed end portion 126 with the closed end 16 of the jacket facing and adjacent the rounded closed end portion 126 of the cavity. Thereupon, a reciprocatory punch 128 having a flat planar distal end 130 is inserted into the open end 14 of the jacket and into engagement with the disc 98. Employing the punch 128, axial pressure is applied to the disc/core/jacket combination to urge the indented and stressed closed end 16 of the jacket, and a portion 132 of the core adjacent the closed end of the jacket, into the rounded closed end portion 126 of the die cavity as depicted in FIG. 7B. This action squeezes the indentations 34 in the interior surface of the closed end of the jacket into closer side-by-side relationship, with concomitant further stressing of the closed end of the jacket as well as lessening of the compressive strength of the closed end of the jacket, hence rendering the closed end of the jacket highly frangible when the leading end of projectile strikes a target.

Thereupon, the partially reformed jacket/core/disc combination is ejected from the die as by an ejector punch 140, following which the partially reformed combination is inserted, open end 14 first, into the cavity 122 of the die 124. While the combination is so positioned, axial pressure is applied to the combination by the reciprocatory punch 128. This action urges the void portion 121 of the open end 14 of the combination 115 partially into the rounded portion 126 of the die cavity to deform the perimeter 116 of the open end of the jacket inwardly toward the longitudinal centerline of the jacket and commence the closure of the open end of the jacket.

The jacket/core/disc having a partially closed, formerly open, end which has been ejected from the die 124 is again inserted into the die 124, but with the now-rounded closed end of the jacket, core, disc combination being inserted into the die first such that this closed end enters the rounded portion 126 of the die cavity 122. Thereupon, a reciprocatory punch 160, having a flat face 162 on its distal end and having a diameter substantially equal to the internal diameter of the die cavity 122 is inserted into the die cavity and into engagement with the partially inwardly formed perimeter 116 of the jacket 12. Axial pressure is applied via the punch 160 against the partially inwardly formed perimeter; 116 of the jacket to further urge that portion of the jacket wall which is adjacent the open end thereof into overlying and covering relationship to the disc, thereby defining a flat trailing end on the projectile and closing the formerly open end of the jacket.

In the course of the action depicted in FIGS. 7B and 7D wherein the closed end of the jacket, with the core seated therein, is deformed into a rounded or ogive geometry, the hard powder (i.e., compacted tungsten powder) which has been seated into the interstices between adjacent ones of the indentations 34 tends to oppose the bending (rounding) of the closed end of the jacket. This action causes the relative ductile metal jacket to "thin-out" to a limited extent adjacent the leading end 120 and develops stresses in the metal jacket adjacent the leading end of the projectile. These factors contribute to the frangibility of the projectile adjacent its leading end.

Whereas the present invention has been described employing specific examples and dimensions, it will be recognized by one skilled in the art that modifications or other embodiments of certain elements of the invention may be altered without departing from the concepts of the invention. In particular, it will be recognized that the pattern of indentations imparted to the closed end of the jacket may assume different geometries and may include more or fewer indentations per unit area of the closed end of the jacket without losing the desired frangibility of the jacket. Further, as noted each indentation need not necessarily be of the same size as others of the indentations, nor of the same geometry as others of the indentations. For example, where the rows of indentations cross one another at angles other than 90 degrees, the cross section of one or more of the indentations may be of a rhomboid or diamond geometry as depicted in FIG. 10. It is therefore intended that the invention be limited only as set forth in the claims appended hereto.

What is claimed:

1. In a precursor for a frangible ammunition projectile having a non-explosive metal powder-based core comprising a metal jacket of a generally hollow cylindrical geometry and having a closed end, an open end and a straight-sided body portion extending between said open and closed ends, and having a substantially flat planar surface thereof facing interiorly of said jacket, a plurality of indentations extending into the thickness of the closed end of the jacket from the interior surface thereof, said indentations being disposed substantially uniformly over the interior surface of the closed end whereby said closed end of the jacket is stressed and rendered frangible and disintegrates into harmlessly sized particulates upon impact of a projectile formed therefrom striking a target.

2. The improvement of claim 1 wherein said indentations extend into the thickness of the closed end of the jacket a distance not greater than about 75% of the thickness of the closed end.

3. The improvement of claim 1 wherein each of said indentations is of a substantially pyramidal geometry having its apex disposed within the closed end.

4. The improvement of claim 1 wherein said indentations are disposed according to a pattern of intersecting linear rows of indentations which extend substantially fully across the interior surface of the closed end.

5. The improvement of claim 1 wherein said indentations are each of substantially like size and shape.

6. A projectile for gun ammunition comprising a metal jacket of generally cylindrical cup-shape and having a closed end, a non-explosive frangible metal powder-based core disposed within said jacket adjacent said closed end, said closed end having an interior surface thereof facing the interior volume of said jacket, a plurality of indentations extending into the thickness of said interior surface of said closed end of said jacket, said indentations being disposed substantially uniformly over the interior surface of the closed end whereby said closed end of the jacket is stressed and rendered frangible and disintegrates into harmlessly sized particulates upon impact of the projectile with a target.

7. The projectile of claim 6 wherein said indentations extend into the thickness of said closed end of the jacket a distance not greater than about 75% of the thickness of said closed end.

8. The projectile of claim 6 wherein each of said indentations is of a substantially pyramidal geometry having its apex disposed within said closed end.

9. The projectile of claim 6 wherein said indentations are disposed according to a pattern of intersecting linear rows of indentations which extend substantially fully across said interior surface of said closed end.

10. The projectile of claim 6 wherein said closed end of said jacket defines a leading end of the projectile when fired from a gun.

11. The projectile of claim 6 wherein said closed end of said jacket defines a trailing end of the projectile when fired from a gun.

* * * * *